US005409233A

United States Patent [19]

Kennedy

[11] Patent Number: 5,409,233

[45] Date of Patent: Apr. 25, 1995

[54] GOLF BALL COATING COMPOSITION

[75] Inventor: Thomas J. Kennedy, Chicopee, Mass.

[73] Assignee: Lisco, Inc., Tampa, Fla.

[21] Appl. No.: 93,094

[22] Filed: Jul. 16, 1993

[51] Int. Cl.[6] ..... A63B 37/12

[52] U.S. Cl. ..... 273/235 A; 273/DIG. 8; 273/235 R

[58] Field of Search ..... 273/233, 235 R, 235 A, 273/DIG. 8

[56] References Cited

U.S. PATENT DOCUMENTS

| | | | |
|---|---|---|---|
| 3,647,221 | 3/1972 | Holley | 273/235 R |
| 4,597,998 | 7/1986 | Mostafa | 427/387 |
| 4,679,794 | 7/1987 | Yamada et al. | 273/235 A |
| 4,798,386 | 1/1989 | Berard | 273/235 |
| 4,802,674 | 2/1989 | Kitaoh | 273/235 A |
| 4,865,326 | 9/1989 | Isaac et al. | 273/235 A |
| 4,871,589 | 10/1989 | Kitaoh et al. | 427/322 |
| 4,911,451 | 3/1990 | Sullivan et al. | 273/235 R |
| 5,000,458 | 3/1991 | Proudfit | 273/235 A |
| 5,018,742 | 5/1991 | Isaac et al. | 273/235 A |
| 5,160,536 | 11/1992 | Harris et al. | 106/20 |
| 5,300,325 | 4/1994 | Nealon et al. | 427/379 |

*Primary Examiner*—James J. Seidleck
*Assistant Examiner*—Mary Critharis

[57] ABSTRACT

A clear coating for a golf ball comprises up to 65% by weight a solvent system including methylamyl ketone (MAK). The clear coating further comprises about 35-90% by weight of a polymer including a hydroxyl-containing resin and an isocyanate such that an equivalent weight ratio of —NCO to —OH is in a range of about 0.9 to 1.4. The coating is comprised of at least 45% solids.

12 Claims, No Drawings

GOLF BALL COATING COMPOSITION

FIELD OF THE INVENTION

The present invention relates to the field of golf balls, and more particularly to improved coating compositions for golf balls. The improved coatings have an increase in solids content over golf ball coatings of the prior art.

BACKGROUND OF THE INVENTION

Many of today's golf balls include at least a core and a cover. The core may be wound, or it may be compression molded form a slug of uncured or lightly cured elastomer composition comprising a high cis content polybutadiene and a metal salt of an $\alpha$, $\beta$, ethylenically unsaturated carboxylic acid such as zinc mono or diacrylate or methacrylate. The molded cores may include metal oxides such as zinc oxide to improve the coefficient of restitution or to increase the core weight. Other materials used in the core composition include compatible rubbers or ionomers, and low molecular weight fatty acids such as stearic acid. Free radical initiator catalysts such as peroxides are admixed with the core composition so that on the application of heat and pressure, a complex curing or cross-linking reaction takes place. Wound cores are generally produced by winding a very large elastic thread around a solid or liquid filled balloon center.

Molded golf ball covers generally include in their compositions ionomeric resins such as those sold by E. I. DuPont de Nemours & Company under the trademark "Surlyn®" and more recently, by the Exxon Corporation (see U.S. Pat. No. 4,911,451) under the trademarks "Escor®" or the tradename "Iotek". These resins have become materials of choice for the construction of golf ball covers over the traditional "balata" (trans polyisoprene, natural or synthetic) rubbers.

The golf balls may be finished by applying one or several finishing coats over the cover. For example, there may be a primer coat and a top coat. Either or both of these coats may be pigmented or clear. Several layers of clear or pigmented coatings may be applied. The clear coatings are applied to golf balls to provide a glossy finish to the ball and to protect any trademark or other indicia which may be stamped or painted onto the ball.

The improvement herein resides generally in the formulation of a urethane clear coat for a golf ball. The clear coat may include a small amount of pigment or dye, yet still remain transparent. The clear coat of the present invention is a two part urethane, essentially comprising a polyol and a polyisocyanate. More specifically, however, the improvement resides in the solvent system included in the clear coating composition. The solvent system permits very high solids coating systems (over 45% solids) to be formulated while still maintaining wet-out of the surface of the golf ball during spray application.

Golf ball clear coatings of the prior art comprise low solids (35% by weight). High solids versions of these coatings are difficult or impossible to apply to the golf balls with the same degree of leveling (i.e., flow out) as the lower solids versions.

It has been found that the difficulties involved in applying the prior art coatings can be overcome by incorporating methylamyl ketone (MAK) into the solvent system. While MAK is used as a solvent for high solids coatings in various industrial applications such as those set forth in U.S. Pat. No. 4,597,998, it is unknown for use as a solvent in preparing golf ball coatings.

The present invention is directed to improved golf ball clear coatings having increased solids content (more than 45% solids) and a desirable measure of wet-out over the prior art clear coatings. Levelling or flow out comparable to that of the lower solids version golf ball coating is also achieved. The coatings are preferably two part urethane and incorporate methylamyl ketone into the solvent system.

These and other features of the invention will be apparent from the following description and from the claims.

SUMMARY OF THE INVENTION

The present invention is directed to a clear coating composition for a golf ball. The clear coating comprises up to 65% by weight of a solvent system including methylamyl ketone (MAK). The clear coat further comprises about 35–90% by weight of a polymer including a hydroxyl-containing resin and an isocyanate or isocyanurate such that an equivalent weight ratio of —NCO to —OH is in a range of about 0.9 to 1.4. The coating composition is comprised of at least 45% solids.

The solvent system, in addition to MAK, may contain methyl isobutyl ketone (MIBK), methyl isoamyl ketone (MIAK), butyl acetate or many other solvents. Various combinations of esters, ketones, hydrocarbons and aromatic solvents may be utilized with the MAK.

The hydroxyl-containing resin or polyol is combined with the MAK and any additives which may be incorporated to form a first part of the overall coating composition. The isocyanate or isocyanurate may be combined with a solvent such as MIBK to form the second part of the overall coating composition. The first and second parts are then combined to form a clear coating. The resulting coating system incorporates a high solids content (greater than 45%) while maintaining wet-out of the golf ball surface during spray application. The coating levels out as well as coating systems of the prior art which are limited to relatively low solids (i.e., around 35% solids by weight).

DETAILED DESCRIPTION OF THE INVENTION

The present invention relates to improved clear coating compositions for golf balls. Specifically, according to the invention, improvements in clear coating compositions for golf balls can be obtained by incorporating methylamyl ketone (MAK) into the coating solvent system. This solvent allows for the application of a coating having a higher solids content over the prior art. It also promotes levelling and wet out of the composition during application.

The coating composition herein is a two-part urethane system. The urethane is prepared from a reaction between polyols and isocyanates or isocyanurates. The —OH of the polyol and the —NCO of the isocyanate form the polyurethane linkage.

The polymeric portion of the coating makes up about 35 to about 90 percent of the coating composition. The MAK or the solvent system which includes MAK makes up to about 65 percent, preferably about 5 to about 55 percent, of the coating composition. Up to about 20 percent of the coating composition is comprised of additives including U.V. stabilizers, flow agents, catalysts, optical brighteners, mar and slip agents, antioxidants, defoaming agents and flattening agents.

When polyols such as, e.g., the Desmophen polyols of Mobay Corporation are combined with polyisocyanates (e.g., Mobay's Desmodur polyisocyanates) to produce polyurethane coatings, the relative amounts of these two components must be determined. For this, the rules of chemistry are followed. Ideally, one equivalent of isocyanate reacts with one equivalent of hydroxyl such that the ratio of —NCO to —OH is about 1.0 to 1.0 (excluding water). In actual practice, however, a small excess of isocyanate is used to allow for the potential destruction of small amounts of isocyanates by any water present in solvents or pigments. As a result, after destruction of the small amounts of isocyanate, the ratio of about 1.0 to 1.0 will be maintained.

Some amounts of polyurea (the resultant polymer product of a polyisocyanate and water) may be desirable in the coating system. A weight ratio of about 10.0 to 0.1 to a ratio of about 10.0 to 4.0 of polyurethane to polyurea produces coatings of varying modulus which may be utilized, depending upon the type of polyisocyanate and polyol, as an effective coating.

The formulations of the present invention are mixed at an index of 1.05. The index is the equivalent weight (i.e., a ratio of the molecular weight of the polymer to one functional group) ratio of the —NCO molecule to the —OH molecule. The ratio may vary from about 0.9 to about 1.4, more likely from about 0.9 to about 1.2.

In order to determine the appropriate amount of isocyanate to incorporate into the composition, the following equation is used:

wt of isocyanate for crosslinking =

(—NCO eq. wt.) (index) (parts of polyol/—OH eq. wt.)

In other words, it is known that Mobay's Desmophen A 160 has an equivalent weight of 1058. Mobay Corporation's Mondur CB-75 isocyanate has an equivalent weight of 323. Using the above equation, the following is obtained:

(323) (1.05) (100/1058)=32.056, weight of isocyanate.

As will be noted in Example 14 below, 100 parts by weight of polyol were combined with 32.1 parts by weight isocyanate to form the coating composition therein. The same basic equation is used in determining the appropriate amount of isocyanate to add in each formulation set forth in the Examples.

In a preferred embodiment, a range of polyols or resins is incorporated at a range of solids. These materials include any material that contains a reactive hydrogen atom that would react with the isocyanate or isocyanurate group. These polyols and/or resins include materials such as hydroxyl functional acrylics (such as Mobay Corporation's Desmophen A 160), hydroxyl functional polyesters (e.g., Mobay Corporation's Desmophen 651A-65), hydroxyl functional polyethers (Desmophen 500U), polyamines (e.g., Ancimine 2071 aliphatic polyamines-modified of Pacific Anchor Chemical Corporation, Los Angeles, Calif.), polyamides (e.g., Shell Chemical Company, Houston, Tex., EPON Curing Agent V-40), short oil alkyds (e.g. AROPLAZ 1133-X-69 of Spencer Kellogg Products Div., Reichold Chemicals Inc., Minneapolis, Minn.), castor oil, epoxy resins with secondary hydroxyl groups (e.g. Shell Chemical Company's EPON Resin 828), phenolic resins (e.g. PENTALYN 802A phenolic - modified PE ester of rosin available from Hercules, Inc., Wilmington, Del.) and hydroxyl functional vinyl resins (e.g. Union Carbide Chemicals and Plastics Co., UCAR Coating Resins, UCAR solution vinyl VMCA hydroxyl functional vinyl resin). The vinyl resins may be used in order to promote adhesion.

Various types of isocyanates may be utilized for cross linking the polyurethane coatings. The four main types include MDI (diphenylmethane 4,4'-diisocyanate), TDI (toluene diisocyanate), IPDI (Isophrone diisocyanate), and HDI (hexamethylene diisocyanate). Polyisocyanates based on HDI represent a significant category of polyisocyanates used in polyurethane coatings. Those coatings which are prepared using the HDI-based products show resistance to chemicals and abrasion. They also exhibit desirable weathering characteristics, including retention of gloss and resistance to yellowing and chalking.

Mobay Corporation's Mondur CB-75 is a TDI polyisocyanate which may be used in the present coating composition.

Mobay's Desmodur N-75, Desmodur N-100 and Desmodur N-3200 are commercially known polyisocyanates based on HDI. They are polymeric materials that contain biuret groups. Desmodur N-75 is a 75% solids version of Desmodur N-100 (100% solids). Desmodur N-3200 is a low viscosity version of Desmodur N-100. The HDI may be converted into a trimer containing an isocyanurate ring. Such products are marketed under trademarks Desmodur N-3300 and Desmodur N-3390.

Desmodur N-3200 isocyanate is preferred for use in the present coating compositions for several reasons. One reason it is preferred is because of its low viscosity to high —NCO functionality ratio. Another reason stems from its aliphatic character which gives the material stability during prolonged exposure to the ultra violet radiation of the sun.

Co-reactants may also be incorporated. These are materials that would either further polymerize with heat or form a film after the evaporation of the solvent. These materials do not react with the isocyanate or isocyanurate, but act on their own to improve the final film properties. A melamine resin such as American Cyanamid Cymel 303 is an example of a heat polymerizable material which may be used herein. An example of a film forming material which may be used is an acrylic, non-hydroxyl containing resin such as Acryloid A-101 solution acrylic available from Rohm & Haas, Philadelphia, Pa.

The solvent or solvent system of the present invention incorporates methylamyl ketone (MAK). The MAK in the formulation allows for very high solids urethane coating systems to be formulated while still maintaining wet-out of the surface of the golf ball during spray application. MAK is the solvent of choice due to its excellent solvating characteristics, along with its latent (slow) evaporation rate. MAK is a latent (i.e., slow evaporating) solvent with a high dipole (i.e., good solvability) constant.

As an alternative to MAK, methyl iso-amyl ketone (MIAK) may be considered for use as a solvent herein. MAK, however, is preferred over MIAK.

The incorporation of "reactive diluents" may also be utilized to improve the flow of high solids coatings. These materials are low molecular weight materials with some type of functional group on the polymer chain. They act to lower the viscosity of the coating and are then polymerized into the coating as it cures. These materials, however, increase the cross link density of the materials and may cause the coating to become brittle. They are known and used throughout the coating industry in general and may find usefulness as a material for golf ball coatings.

Cosolvents may be included in the solvent system. These may include butyl acetate, methyl isobutyl ketone (MIBK), Dowanol PMA available from Dow Chemical U.S.A., Midland, Mich., or others. The cosolvents may be added in order to fine tune flow or evaporation characteristics of the coating composition. Too much flow will cause the coating to bead up on the outermost or "land" (non-dimpled) sections of the golf ball, and form puddles in the dimples of the golf ball such that the edge between the "land" and the dimples is left with a shortage of coating.

Table 1 identifies the properties of some of the solvents which may be used in the coating compositions of the present invention:

Another type of additive which may be incorporated into the coating includes U.V. absorbers such as Ciba Geigy's Tinuvin 1130 benzotriazole U.V. absorber and Sanduvor 3206 oxalamide derivative U.V. stabilizer available from Sandoz Chemicals Corporation, Charlotte, N.C. These components absorb ultra violet light and re-emit it as heat.

Optical brighteners may be added. Examples of suitable optical brighteners used on golf balls include Ciba Geigy's Uvitex OB 2,2'-(2,5-thiophenediyl)bis(5-tert-butylbenzoxazole) optical brightener and Lucopure EGM coumarin optical brightener available from Sandoz Chemical Corporation. The optical brighteners are used to check coating coverage over the golf ball under ultra violet light. They are also used to brighten the ball's appearance.

Although in the preferred embodiment the coating is a clear coating, it is within the scope of the present invention to incorporate pigments into the coating formulation. The typical materials used are white pigments; $TiO_2$ (titanium dioxide); Blanc Fix (i.e. barium

TABLE 1

| | SOLVENT PROPERTIES | | | |
|---|---|---|---|---|
| SOLVENT | METHYL ISOBUTYL KETONE (MIBK) | METHYL ISOAMYL KETONE (MIAK) | METHYL n-AMYL KETONE (MAK) | n-BUTYL ACETATE |
| Formulation | $CH_3COCH_2CH(CH_3)_2$ | $CH_3COC_2H_4CH(CH_3)_2$ | $CH_3COC_5H_{11}$ | $CH_3COOC_4H_9$ |
| Evaporation Rate, nBuOAc = 1 | 1.6 | 0.5 | 0.4 | 1.0 |
| Viscosity, cP @ 25° C. | 23 | 27 | 26 | 33 |
| Dilution Ratio | | | | |
| Tolune | 3.5 | 4.1 | 3.9 | 2.7 |
| Naphtha | 1.0 | 1.2 | 1.2 | 1.2 |
| Specific Gravity 20°/20° C. | 0.802 | 0.814 | 0.817 | 0.883 |
| Lbs/Gal @ 20° C. | 6.67 | 6.76 | 6.80 | 7.35 |
| FlashPoint °F. | | | | |
| T.C.C. | 60 | 96 | 102 | 81 |
| T.O.C. | 68 | 106 | 114 | 85 |
| Solvent Constants | | | | |
| Solubility Parameter | 8.6 | 8.3 | 9.0 | 8.7 |
| Hydrogen Bonding | 7.8 | 7.8 | 8.3 | 6.6 |
| Dipole Moment | 2.7 | 2.7 | 2.6 | 1.8 |
| Solubility at 20° C., wt % | | | | |
| in water | 2.0 | 0.5 | 0.5 | 0.7 |
| water in | 1.0 | 1.2 | 1.3 | 1.6 |
| Azeotrope | | | | |
| BP °C. | 87.9 | 94.7 | 95 | 90.2 |
| wt % water | 24.3 | 44 | 48 | 28.7 |
| Boiling Range 760 torr, °C. | 114–117 | 141–148 | 147-153.5 | 124–129 |
| Blush Resistance % R.H. @ 80° F. | 78 | 89 | 93 | 83 |
| Gram Molecular Weight | 100.16 | 114.19 | 114.19 | 116.16 |
| Electrical Resistance, Megohms | 0.4 | 0.6 | 0.4 | >20 |

Levelling additives may be added to reduce the surface tension of the coating for improved flow. Examples of leveling additives which may be used in the present clear coating composition include, but are not limited to, Fluorad FC-430 fluorochemical surfactants available from 3M Industrial Chemical Products Div., St. Paul, Minn., and 57 ADDITIVE silicone additive available from Dow Corning Corporation, Midland, Mich.

A hindered amine U.V. stabilizer such as the Tinuvin 292 hindered amine light stabilizer of Ciba-Geigy Corporation, Ardsley, N.Y., may be added. This material functions to tie up free radicals in the coating that are produced upon exposure to ultra violet radiation. As a result, the U.V. stabilizers serve to maintain the integrity of the coating.

sulfate ($BaSO_4$)); ZnO; Lithopone (i.e. a mixture of $ZnO+BaSO_4$) and magnesium silicate (talc). Adjustments are made for the oil absorption and the hiding (opacity) of the various pigments on a formula by furmua basis.

The coating composition of the present invention may be applied to any surface that is solvent resistant and fairly rigid (i.e., a flexural modulus of between about 5,000 and about 100,000). An ionomer substrate provides for a desirable surface, although balata, synthetic balata, polyethylene, polypropylene and polyurethane also provide good surfaces. The coating may be applied directly to the substrate, although some type of pretreatment to the surface may be required. Typically, the coating is applied as a top coat over a primer. The primer is usually more flexible to act as a tie coat between the ionomer and the top coat. An example of suitable primers include the Witcobond Witco-W-234 water borne aliphatic polyurethane primer available from Witco Corporation, New York, N.Y.

Other suitable primers include epoxy-amidoamine coatings, epoxy-amine coatings and Miles, Inc. Baybond water borne polyurethane dispersions (Baybond PU 402A 110, 114, 121 and 123).

Imperial Chemical Industries ZENECA Resins Div., Wilmington, Mass., also manufactures water borne aromatic and aliphatic polyurethane dispersions, as well as acrylic emulsions, that may be utilized as primers for golf balls. These include NeoRez R-967, NeoRez R-972 and NeoRez R-962 for the polyurethanes and NeoCryl A-614, NeoCryl A-636, NeoCryl A-1052 and NeoCryl A-5038 for the acrylic emulsions.

By way of example, the Witco-W-234 primer has the following specifications:

| | |
|---|---|
| Viscosity Brookfield (RVF #2 @ 20) | 38–42 cP |
| Zahn #2) | 19–21 seconds |
| pH @ 25° C. | 7.9–8.1 |
| Solids | 29–31% |
| Wt/gal | 8.78–8.82 lbs. |
| Color | translucent |

The MAK coating may also be applied over a painted layer.

The MAK coating of the present invention is made in two parts. A first part or Part A includes the polyol. Typically, in addition to the polyol, this part includes the MAK solvent and any additives which are to be added. A second part or Part B includes the isocyanate and the solvent. In many cases, the Part B solvent is MIBK to alleviate any moisture problems which may be encountered with the butyl acetate. In some instances, problems were encountered when butyl acetate was mixed with the Desmodur N-3200. It is fully within the scope of this invention for no solvent to be included in the part B isocyanate component, or for the MAK solvent to be used in the isocyanate part. The following table lists specifications for the MAK top coat for a golf ball:

| | Part A | Part B |
|---|---|---|
| Viscosity Zahn #2 | 21–23 sec. | 16–18 sec. |
| Brookfield (1 @ 20 rpm on RVF) | 22–23 | 21.5–22.5 |
| Solids | 40.4–41% | 60–61% |
| Wt/gal | 8.2–8.3 | 8.2–8.3 |
| Color (Gardner Scale) | ≦2 | ≦3 |
| Gloss | ≧92° @ 60° (mixed coating) | |
| Tack free | 6 hours @ 130° F. (mixed coating) | |

The coating is applied utilizing a pressure pot and an air atomizing spray gun. The polyol and isocyanate portions are premixed in the pressure pot. The MAK may be contained in either the polyol portion of the coating or in the isocyanate portion.

The coating is pushed to the spray gun using dry air where it is forced out of a small diameter (0.1 inch) fluid nozzle. The material is then "broken up" or atomized at the tip of the gun by the air cap, again using dry air. This forms a fan of fine droplets that are impinged upon the surface of the golf ball. The golf balls are then placed in a 130° F. oven for about 6 hours where the solvent is allowed to evaporate and the polyisocyanate and the polyol combine to form a polyurethane coating.

The adhesion of the coating to the golf ball is tested through the use of a very dynamic test called the "wet barrel" test. A dozen finished and cured golf balls that have been out of the oven for at least 48 hours are soaked in tap water for 3 hours. These balls are then shot at 125 feet/second against a steel wall that is at a 45 degree angle to the vector of the golf ball. The steel wall also has vertical corrugations on it to simulate the face of a golf club. The ball is allowed to bounce around in the hexagonal shaped barrel and then, when it reaches the bottom of the barrel, it is returned to the beginning of the cycle. This test is run 100 times. At the end of the test, the golf balls are dyed using a dye such as one available from Pylam Products Co., Garden City, N.Y. (e.g. Pylam DuPont Fiber Identification Stain #4). This material stains the coating brown, but leaves the ionomer (cover layer) white, thus showing areas where the coating has worn off. Golf balls are categorized as a PC0, PC1, PC2, PC3 AND PC4 depending on the amount of coating that is missing. PC0 is a golf ball with no coating missing.

This test is also run on golf balls that have been aged in a xenon arc weatherometer for 72 hours as well as golf balls that have been exposed to the elements in South Florida for periods of 8, 16, 32, 64, 96 and 128 days.

Another important aspect of the coating application is the degree of gloss on the golf ball after the coating has been cured. A phenomenon called "orange peel" leaves a rough surface on the golf ball and lowers the initial gloss. Orange peel is usually due to two factors: poor wetting of the substrate and/or poor leveling of the coating. This is another aspect where incorporating MAK into the coating helps the aesthetics of the golf ball.

The present invention is further illustrated by the following examples in which the parts of the specific ingredients are by weight (pbw). It is to be understood that the present invention is not limited to the examples, and various changes and modifications may be made in the invention without departing from the spirit and scope thereof.

EXAMPLES

Example 1

A golf ball clear coating was prepared in accordance with the present invention. The polyol and the isocyanate parts of the resulting urethane coating were separately prepared and then combined. The coating formulation is set forth in the following table (Table 2):

TABLE 2

| | phr | % COMPLETE | % PART | wt/gal | wt/gal % COMPLETE | wt/gal % PART | SOLIDS | SOLIDS % |
|---|---|---|---|---|---|---|---|---|
| 1. Desmophen 651-A-65 | 100 | 29.82% | 43.78% | 9.2 | 2.7430 | 4.0280 | 0.65 | 19.380% |
| 2. Desmophen 670-80 | 30 | 8.94% | 13.13% | 9.2 | 0.8229 | 1.2084 | 0.8 | 7.156% |

TABLE 2-continued

| | phr | % COMPLETE | % PART | wt/gal | wt/gal % COMPLETE | wt/gal % PART | SOLIDS | SOLIDS % |
|---|---|---|---|---|---|---|---|---|
| 3. MIBK | 10 | 2.98% | 4.38% | 6.67 | 0.1989 | 0.2920 | 0 | 0.000% |
| 4. Butyl acetate | 35 | 10.44% | 15.32% | 7.35 | 0.7670 | 1.1263 | 0 | 0.000% |
| 5. MAK | 50 | 14.91% | 21.89% | 6.8 | 1.0137 | 1.4886 | 0 | 0.000% |
| 6. 3M FC 430 | 0.3 | 0.09% | 0.13% | 9.16 | 0.0082 | 0.0120 | 1 | 0.089% |
| 7. Sandoz 3206 | 2 | 0.60% | 0.88% | 8.41 | 0.0501 | 0.0736 | 1 | 0.596% |
| 8. Tinuvin 292 | 1 | 0.30% | 0.44% | 8.267 | 0.0246 | 0.0362 | 1 | 0.298% |
| 9. Uvitex OB | 0.1 | 0.03% | 0.04% | 10.579 | 0.0032 | 0.0046 | 1 | 0.030% |
| Subtotal | 228.4 | 68.098% | 100.00% | | | 8.2699 | | 27.549% |
| 10. Desmodur N-3200 | 67 | 19.98% | 62.62% | 9.3 | 1.8578 | 5.82 | 1 | 19.976% |
| 11. MIBK | 40 | 11.93% | 37.38% | 6.67 | 0.7955 | 2.49 | 0 | 0.000% |
| Subtotal | 107 | 31.902% | 100.00% | | | 8.3168 | | 19.976% |
| TOTAL | 335.4 | 100.00% | | | 8.285 | | | 47.525% |

The polyol was first mixed with the various additives, including a leveler, a U.V. stabilizer, a U.V. absorber and an optical brightener. The polyol was also mixed with a solvent system comprising MAK, MIBK and butyl acetate. This polyol part was then combined with the isocyanate part comprised of Desmodur isocyanate and MIBK solvent. The MIBK is used as the solvent in the isocyanate in order to alleviate any potential moisture problems encountered with butyl acetate.

The specific formulation and solids content of each component are provided in the above Table 2. The solids content of the overall coating composition is 47.525%, with 26,536% attributed to the Desmophen polyol solids and 19.976% attributed to the Desmodur isocyanate solids. The remaining solids (1.013% of the overall coating composition) are attributed to the various additives, (i.e., U.V. stabilizer, U.V. absorber and optical brightener). The top coat described in this example has a weight of 8.2849 lbs. per gallon, and an index of 1.05.

When applied to golf balls, it was noted that the coating exhibited good flow-out under laboratory conditions. In other words, good coverage was observed on waterborne primed balls at a wetness of 70 mg. The amount of MAK-containing coating applied ranged from 0.16 to 0,139 gal/100 dozen golf balls. This was an improvement over the prior art standard non-MAK-containing clear coats (both aliphatic and aromatic) which require application of about 0.2 gal of coating per 100 dozen golf balls (wherein a 35% solids aromatic two part polyurethane is used as the golf ball top coat). The improvement is attributed to the increase in solids content based on use of a MAK-based solvent system.

Example 2

Another clear coating composition was prepared according to the following formulation:

TABLE 3

| | phr | % COM-PLETE | % PART | wt/gal | wt/gal % COM-PLETE | wt/gal % PART | SOLIDS | SOLIDS % | MIX-TURE | OH EQ % | OH PHR |
|---|---|---|---|---|---|---|---|---|---|---|---|
| | | | | | | | | | OH EQ | | |
| 1. Desmophen 651-A-65 | 100 | 33.83% | 53.94% | 9.2 | 3.1127 | 4.9622 | 75.00% | 25.375% | 365 | 357.843 | 100.000 |
| 2. Butyl acetate | 30 | 10.15% | 16.18% | 7.35 | 0.7460 | 1.1893 | 0.00% | 0.000% | | | |
| 3. MAK | 50 | 16.92% | 26.97% | 6.8 | 1.1503 | 1.8339 | 0.00% | 0.000% | | | |
| 4. BYK 370 | 2 | 0.68% | 1.08% | 7.6 | 0.0514 | 0.0820 | 25.00% | 0.169% | 1600 | 31.373 | 2.000 |
| 5. 3M FC 430 | 0.3 | 0.10% | 0.16% | 9.16 | 0.0093 | 0.0148 | 100.00% | 0.101% | | | |
| 6. Sandoz 3206 | 2 | 0.68% | 1.08% | 8.41 | 0.0569 | 0.0907 | 100.00% | 0.677% | | | |
| 7. Tinuvin 292 | 1 | 0.34% | 0.54% | 8.267 | 0.0280 | 0.0446 | 100.00% | 0.338% | | | |
| 8. Uvitex OB | 0.1 | 0.03% | 0.05% | 10.579 | 0.0036 | 0.0057 | 100.00% | 0.034% | | | |
| Subtotal | 185.4 | 62.727% | 100.00% | | | 8.2233 | | 26.694% | 1965 | 389.216 | 102.00 |
| | | | | | | | | | NCO EQ | NCO EQ % | NCO PHR |
| 9. Desmodur N-3200 | 70.17 | 23.74% | 63.69% | 9.3 | 2.2078 | 5.92 | 100.00% | 23.740% | 255 | 255.00 | 70.168 |
| 10. MIBK | 40 | 13.53% | 36.31% | 6.67 | 0.9027 | 2.42 | 0.00% | 0.000% | | | |
| Subtotal | 110.17 | 37.273% | 100.00% | | | 8.3451 | | 23.740% | | 255.00 | |
| TOTAL | 295.57 | 100.00% | | | 8.269 | | | 50.434% | | | |

Here again, the polyol and isocyanate parts were prepared separately and the combined to form the urethane coating composition. The polyol part contains 26.694% solids, and the isocyanate part contains 23,740% solids. The two parts, when combined, are comprised of 50,434% solids. A gallon of the top coat weighs about 8.2687 pounds, and the coating index is 1.05.

The coating was applied to golf balls. The amount of MAK-containing coating needed for application to 100 golf balls ranged from 0.155 gal/100 dozen balls as a worst case scenario to 0.139 gal/100 dozen golf balls in the best case. This again was an improvement over the prior art standard non-MAK-containing clear coats (both aliphatic and aromatic) which require application of about 0.2 gal of coating per 100 dozen golf balls (wherein the coating included runs of a 35% solids aromatic two part polyurethane golf base top coat). This improvement is again attributed to the increase in solids content based on use of a MAK-based solvent system.

Examples 3–8

Top coat MAK-based compositions were prepared according to the following formulations:

TABLE 4

| Example | 3 | 4 | 5 | 6 | 7 | 7A | 8 |
|---|---|---|---|---|---|---|---|
| Desmophen 65I-A-65 | 100.0 | 100.0 | 100.0 | 100.0 | 100.0 | 100.0 | 100.0 |
| Desmophen 670-80 | 30.0 | 30.0 | 30.0 | 30.0 | | | 30.0 |
| Butyl Acetate | 35.0 | 35.0 | 35.0 | 35.0 | 30.0 | 30.0 | 10.0 |
| MIBK | 50.0 | 50.0 | 50.0 | 50.0 | 40.0 | 40.0 | 20.0 |
| MAK | 50.0 | 50.0 | 50.0 | 50.0 | 50.0 | 50.0 | 34.0 |
| 3M FC-430 | 0.45 | 0.9 | 0.45 | 0.45 | 0.3 | 0.3 | 0.3 |
| Tinuvin 292 | 1.0 | 1.0 | 1.0 | 1.0 | 1.0 | 1.0 | 1.0 |
| Tinuvin 1130 | 2.0 | 2.0 | 2.0 | | | | |
| Sandoz 3206 | | | | 2.0 | 2.0 | 2.0 | 2.0 |
| Uvitex OB | 0.1 | 0.1 | 0.1 | 0.1 | 0.1 | 0.1 | 0.1 |
| BYK 370 | | | | | | 2.0 | |
| Desmodur N-3200 | 67.0 | 67.0 | | 67.0 | 71.18 | 67.0 | 67.0 |
| Desmodur N-3300 | | | 72.0 | | | | |

The coating of Example 3 was applied to a water-borne primed golf ball. The coating flowed out well in the laboratory. In other words, good coverage was observed on a water-borne primed ball at 70 mg wet. The coated balls were subjected to hit testing. The coating of the Example 3 formulation exhibited good adhesion and abrasion resistance at 100 blows.

A pilot plant was set up for the formulation of Example 3. Five gallons of the coating were prepared for the pilot. The coating was applied using a pressure pot set at 3 lbs., with atomizing pressure set at 50 lb. The this instance, the wet weight was 108 mg and coverage was good. When the same coating was applied to epoxy primed balls, the observed flow out was at least as good as or better than that which was observed with respect to the water borne primed balls. This is attributable to the fact that generally, water borne primers, due to the molecular weight of the polymer, are inherently more difficult to spray over than are epoxy primers.

The remaining coatings (Examples 4–8) were prepared and tested on golf balls primed with waterborne primers. They exhibited good flow out and provided for coatings having a durable top coat with good weathering characteristics.

In Example 5, Desmodur N-3300 was used in place of Desmodur N-3200 of Example 3. The Desmodur N-3300 is an isocyanurate trimer. The resulting coating provided a durable top coat for golf balls with good weathering characteristics.

In Examples 6, 7 and 7A, Sanduvor Sandoz 3206 oxalamide derivative U.V. stabilizer available from Sandoz Chemical Corporation (a narrow spectrum absorber) was substituted for Tinuvin 1130 (a broad range absorber) to allow more U.V. light to penetrate the coating on the golf ball and activate the optical brightener in the cover. The Tinuvin 1130 absorbs different ultra violet rays than the Sandoz 3206 and does not allow the optical brightener to fluoresce to the same extent as the Sandoz 3206. The Sandoz 3206 absorbs less of the U.V. spectrum (approximately 300 nanometers and lower) while the Tinuvin 1130 absorbs strongly throughout the U.V. spectrum.

In Example 7A, The same formulation as that of Example 7 was prepared, with the exception that BYK 370 hydroxyl functional silicone available from BYK-Chemie U.S.A., Wallingford, Conn., was added. It should be noted that BYK 371 may be substituted for BYK 370 (0.1 to 5.0% of total formula). The materials of examples 7 and 7A sprayed well. Their durability upon exposure to media tumble was favorable. Sand tumble was also favorable.

Example 9

A top coat was prepared according to the following overall composition:

| | |
|---|---|
| Desmophen A-365 (eq. wt. 607) | 100.0 |
| MAK | 30.0 |
| MIBK | 30.0 |
| Butyl Acetate | 20.0 |
| 3M FC-430 | 0.4 |
| Tinuvin 292 | 1.0 |
| Sandoz 3206 | 2.0 |
| Uvitex OB | 0.1 |
| Desmodur N-3200 | 32.0 |

The golf balls that were coated with this formulation were placed in the weatherometer to test for yellowing. The balls showed excellent gloss and color retention after 48 hours in the weatherometer and 100 cycles in the pneumatic cannon. The coating also adhered very well, with no dimples popping.

Example 10

Golf balls were coated with a top coat having the following formulation:

| | |
|---|---|
| Formrez 102 | 100.0 |
| MAX | 50.0 |
| MIBK | 50.0 |
| Butyl Acetate | 35.0 |
| 3M FC-430 | 0.3 |
| Tinuvin 292 | 1.0 |
| Sandoz 3206 | 2.0 |
| Uvitex OB | 0.1 |
| | 238.4 |
| Desmodur N-3200 | 106.0 |
| | 344.4 |

Fromrez 102 is a trimethylol propane branched adipate polyester available from Witco Corporation, New York, N.Y.

A material having the above formulation was sprayed at 108 mg. The material sprayed well. A double coating was sprayed of this material.

The material cured very poorly without the presence of a catalyst in the system. This caused the material to run, forming a drip on the balls and ruining the trademark indicia.

Example 11

A coating composition of the following composition was prepared:

| | |
|---|---|
| Joncryl SCX 910 (77% solids) | 100.0 |
| MAK | 30.0 |
| MIBK | 30.0 |
| Butyl Acetate | 20.0 |
| 3M FC-430 | 0.4 |
| Tinuvin 292 | 1.0 |
| Sandoz 3206 | 2.0 |
| Uvitex OB | 0.1 |
| Desmodur N-3200 | 30.0 |

Joncryl SCX 910 is an acrylic polyol available from S.C. Johnson & Son, Inc., Racine, Wis.

Hydroxyl functional acrylic polyols are used in the above formulation. These may be obtained from Rohm & Haas; S.C. Johnson & Son, Inc. of Racine, Wisc.; Miles, Inc., Industrial Chemicals Division, Pittsburgh, Pa.; Henkel Corporation, La Grange, Ill.; and other suppliers. They provide improved lightfastness over polyester polyols, though they do not exhibit desired adhesion to the golf ball.

The above formulation comprises 51.3% solids.

The golf balls that were sprayed with this coating were fine for adhesion passing 48 house exposure in the weatherometer at 0.65 $W/m^2$ illumination. This coating exhibited a high resistance to yellowing. However, there was a great degree of gloss lost due to the fact that the coating abraded, especially on the land area. This may be attributed to the high equivalent weight (650) for this material.

Example 12

Another coating composition was prepared according to the following overall formulation:

| | |
|---|---|
| Desmophen 800 | 100.0 |
| MAK | 65.0 |
| MIBK | 65.0 |
| Butyl Acetate | 40.0 |
| 3M FC-430 | 0.3 |
| Tinuvin 292 | 1.0 |
| Sandoz 3206 | 2.0 |
| Uvitex OB | 0.1 |
| | 238.4 |
| Desmodur N-3200 | 66.0 |
| | 304.4 |

The above formulation was mixed and applied to golf balls and subjected to wet barrel testing and testing in the weatherometer. Initial gloss was excellent but, after wet barrel testing, the gloss decreased significantly, owing to the low modulus of the coating. It was further determined that the material is rather soft. The Desmophen 800 is more of a linear polymer than the Desmophen 631 A-75.

Example 13

MAK solvent was used in the formulation of an acrylic-based coating composition:

| | |
|---|---|
| Polytex 975 | 100.0 |
| MAK | 45.0 |
| MIBK | 35.0 |
| 3M FC-430 | 0.3 |
| Sandoz 3206 | 2.0 |
| Tinuvin 292 | 1.0 |
| Uvitex OB | 0.1 |

-continued

| | |
|---|---|
| Tolonate HDB-75BX | 73.36 |

Polytex 975 is an acrylic polyol available from Shell Chemical Company, Houston, Tex.

Tolonate HDB-75BX is an aliphatic polyisocynate as a solution in a 1:1 butyl acetate:xylene mixture. It is available from Rhone Poulene, Inc., Cranbury, N.J.

The above material sprayed well at 123 mg/ball.

The balls were exposed on cycle #5 in the weatherometer @0.65 $W/m^2$. These balls were then hit tested. The balls showed no failure after hit test and showed excellent gloss retention.

Example 14

The formulations of Examples 1 and 2 above provide for preferred coating systems. The remaining formulations set forth in above examples also provide adequate coating, although the abrasion resistance and adhesion are not as good as those of Examples 1 and 2.

The following formulation was prepared:

| | |
|---|---|
| Desmophen A 160A | 100.0 pbw |
| Union Carbide VMCA | 20.0 |
| Dowanol PMA | 20.0 |
| MAK | 55.0 |
| Tinuvin 292 | 1.0 |
| Tinuvin 1130 | 2.0 |
| Lucopure EGM | 0.1 |
| DOW 57 | 0.3 |
| Mondur CB-75 | 32.1 |

This formulation incorporates a polyacrylic polyol (160A), an aromatic TDI polyisocyanate (CB-75), a slower evaporating solvent (e.g. Dowanol PMA propylene glycol monomethyl ether acetate available from Dow Chemical U.S.A., Midland, Mich.), a different flow additive (DOW 57), a different U.V. stabilizing package (292/1130) and a different optical brightener. This formulation provides for a fair to adequate golf ball coating and, in fact, is a formulation similar to one known in the art (excluding MAK), with the exception that the known formulation is lower in solids to compensate for the loss of the MAK. Further, the polyacrylic/VYNS vinyl polyol system produces a polyurethane that is not as abrasion resistant, and the CB-75 causes the film to yellow quickly upon exposure to ultra violet rays. The ultra violet stabilizing package is not as efficient as that in Examples 1 and 2.

The invention has been described with reference to the preferred embodiments. Obviously, modifications and alterations will occur to others upon a reading and understanding of the preceding detailed description. It is intended that the invention be construed as to include all such alterations and modifications insofar as they come within the scope of the claims and the equivalents thereof.

I claim:

1. A golf ball, comprising:

a core;

a cover molded on said core; and a coating over said cover, said coating being a polyurethane coating including about 35 to 90% by weight of a polyol and an isocyanate combination such that an equivalent weight ratio of —NCO to —OH in the combination is in a range of about 0.9 to about 1.4, said polyurethane coating further including up to about 65% of a solvent system including methylamyl ketone.

2. A golf ball, as set forth in claim 1, wherein the equivalent weight ratio of —NCO to —OH is about 1.05.

3. A golf ball, as set forth in claim 1, wherein the solvent system including methylamyl ketone is present in a range of about 5 to 55% by weight.

4. A golf ball, as set forth in claim 1, wherein the coating comprises two parts, a polyol part and an isocyanate part, the polyol part comprising a polyol and methylamyl ketone, the isocyanate part comprising an isocyanate, the polyol part and the isocyanate part being separately prepared and later combined to form the coating.

5. A golf ball, as set forth in claim 4, wherein a solids content of the coating is in a range greater than about 45% of the overall composition.

6. A golf ball, as set forth in claim 4, wherein the polyol part further includes up to about 20% by weight of additives including U.V. stabilizers, U.V. absorbers, and optical brighteners.

7. A golf ball, as set forth in claim 1, wherein the solvent system includes methylamyl ketone and a solvent selected from the group consisting of methyl isoamyl ketone, methyl isobutyl ketone, and butyl acetate.

8. A golf ball, as set forth in claim 1, wherein a waterborne primer layer links the cover and the coating.

9. A golf ball comprising a clear coat applied as the outermost layer of the golf ball, an improvement in the clear coat comprising the inclusion of up to 65% of the weight of the clear coat a solvent system including methylamyl ketone, the clear coat further comprising 35 to 90% by weight of a polymer including a hydroxyl-containing resin and an isocyanate such that an equivalent weight ratio of —NCO to —OH is in a range of about 0.9 to 1.4.

10. A golf ball, as set forth in claim 9, wherein the solvent system comprises 5 to 55% by weight of the overall composition of the clear coat.

11. A golf ball, as set forth in claim 9, wherein the equivalent weight ratio of —NCO to —OH is about 1.05.

12. A golf ball, as set forth in claim 9, wherein the overall clear coat comprises at least 45% by weight solids.

* * * * *